US005115712A

United States Patent [19]

Sprafke

[11] Patent Number: 5,115,712

[45] Date of Patent: May 26, 1992

[54] MILITARY TANK

[75] Inventor: Uwe Sprafke, Schauenburg-Elmshagen, Fed. Rep. of Germany

[73] Assignee: Wegmann & Co. GmbH, Schauenburg-Elmshagen, Fed. Rep. of Germany

[21] Appl. No.: 624,370

[22] Filed: Dec. 6, 1990

[30] Foreign Application Priority Data

Dec. 7, 1989 [DE] Fed. Rep. of Germany ..... 3940418

[51] Int. Cl.[5] ..... F41H 7/00; F41H 5/18; F41G 1/30; F41G 3/00

[52] U.S. Cl. ..... 89/36.14; 89/37.12

[58] Field of Search ..... 89/36.14, 37.12

[56] References Cited

U.S. PATENT DOCUMENTS 3,482,897 12/1969 Hopp ..... 89/36.14
3,493,296 2/1970 Albert ..... 89/36.14
3,672,607 6/1972 Stauff et al. ..... 89/36.14
3,790,248 2/1974 Kellow ..... 89/36.14
4,978,206 12/1990 Neuman et al. ..... 89/36.14

*Primary Examiner*—David H. Brown
*Attorney, Agent, or Firm*—Sprung, Horn, Kramer & Woods

[57] ABSTRACT

A miliary tank with a turret accommodating a heavy weapon that can be elevated and that has a barrel mounted in a cradle and extending out through a shield, wherein the optical axis of a sight mounted stationary on the weapon extends through the cradle, paralleling the longitudinal axis of the bore, toward on objective on the outside of the turret. The optical axis of the sight between the cradle and the shield is deflected up by an optical deflector to a point in or on the turret and above the shield, whence it is deflected forward toward the objective by another optical deflector.

3 Claims, 5 Drawing Sheets

MILITARY TANK

BACKGROUND OF THE INVENTION

The invention concerns a military tank with a turret accommodating a heavy weapon that can be elevated and has a barrel mounted in a cradle and extending out through a shield, whereby the optical axis of a sight mounted stationary on the weapon extends through the cradle, paralleling the longitudinal axis of the bore, toward an objective on the outside of the turret.

The optical axis of the sight employed in known tanks of this type extends, as will be specified hereinafter with reference to the drawing, straight forward through the cradle and shield, and the objective is accordingly on the front of the shield.

It has been demonstrated that the straight perforation for the optical axis of the sight results in a discontinuity in the defensive superstructure of the armor, which represents a weak point. Due to the penetrating capacity of up-to-date ammunition, such weak points are multiply larger than the opening actually needed for the optical axis.

Furthermore, since the opening for the optical axis of the sight is next to the barrel the shield must be relatively wide, which adds to its weight and hence to the unbalance that must be overcome when the barrel is elevated.

SUMMARY OF THE INVENTION

The object of the invention is to improve a military tank of the aforesaid type to the extent that no additional discontinuity in the defensive superstructure is necessary in the vicinity of the shield.

This object is attained in accordance with the invention in that the optical axis of the sight between the cradle and the shield is deflected up by an optical deflector to a point in or on the turret and above the shield, whence it is deflected forward toward the objective by another optical deflector. The objective can be positioned in slots on the front of the turret or in the roof of the turret.

The basic concept of the invention is to eliminate the need for an objective in the form of an opening in the shield by deflecting the optical axis of the sight, leaving the defensive superstructure intact and strong.

The invention can be built into existing equipment or employed with equipment in the course of development designed with the optical axis of its sight deflected in accordance with the invention so that its objective can be positioned for example in the roof or in slots above the armor.

The optical axis of the stationary sight in accordance with the invention also allows the shield to be much narrower and hence reduces weight and unbalance to a minimum. This is a particular advantage in shields with a defensive superstructure that renders them very thick. When an optical axis has to extend through a very thick shield, the perforation must be larger, which considerably decreases the defense.

It is also possible to construct the shield of moving and stationary components with the deflected section of the optical axis behind the stationary components and the barrel extending through the moving components. This approach will also definitely reduce the moving parts of the defensive superstructure.

The invention and its difference from the state of the art will now be specified with reference to the drawing.

DETAILED DESCRIPTION OF THE INVENTION

Figure 1:
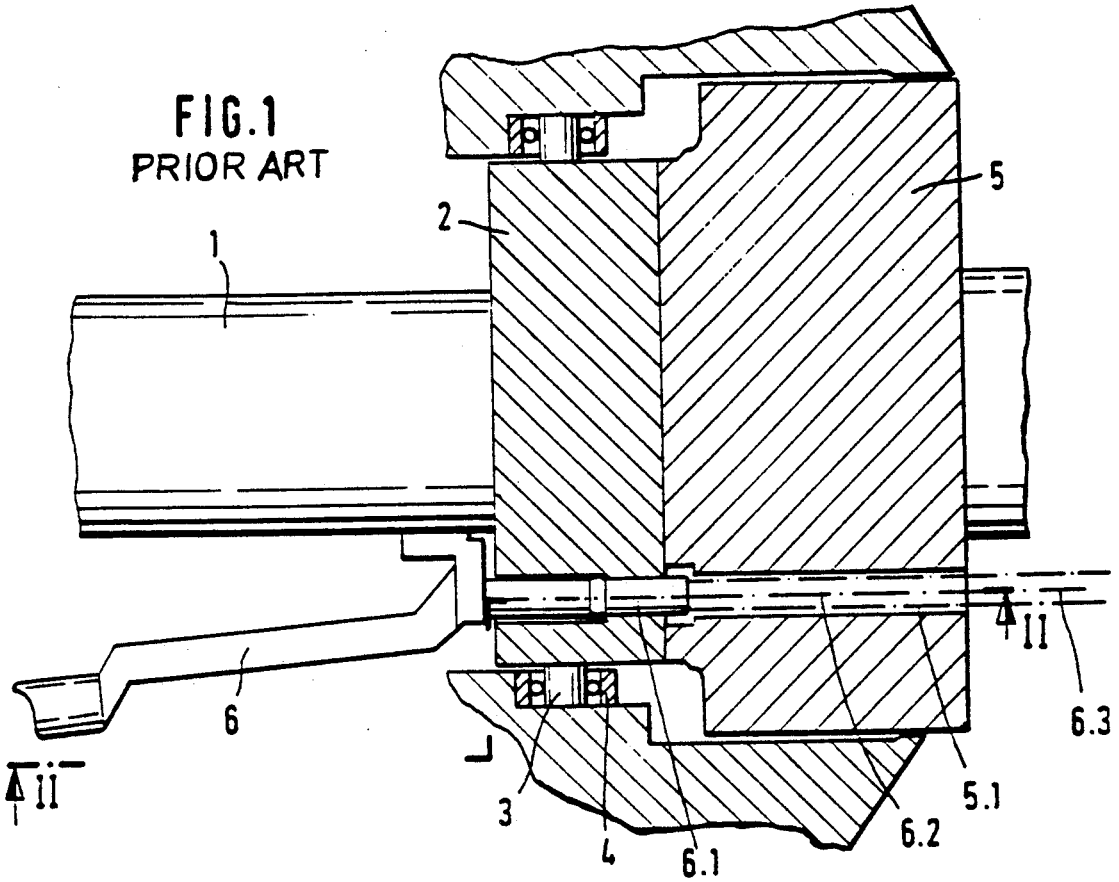
FIG.1 PRIOR ART
FIG. 1 is a schematic partly sectional view of the vicinity of the cradle and shield on the state-of-the-art turret of the tank illustrated in FIG. 1*a*.
Figure 1A:
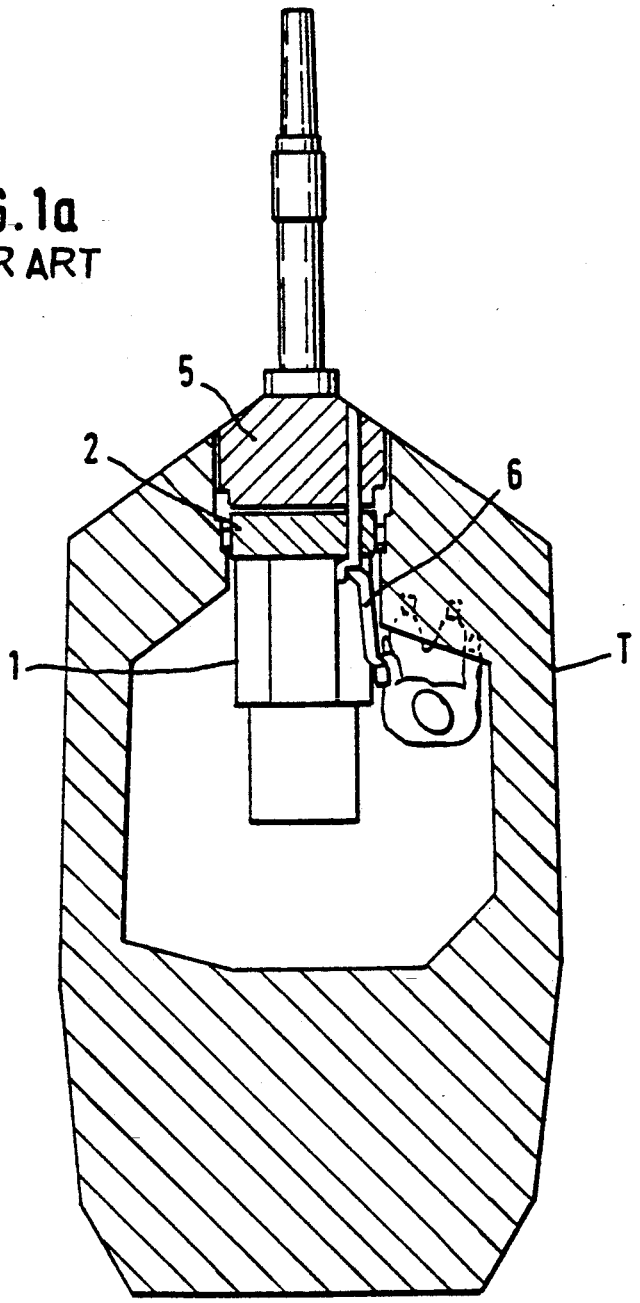
FIG. 1a PRIOR ART
FIG. 1*a* in a schematic horizontal section through the turret of a military tank.

FIG. 1*a* shows a turret T that accommodates the barrel 1 of a heavy weapon, which extends out of the turret and can be elevated. Only the parts discussed in what follows are illustrated. As will be evident from FIGS. 1*a*, 1, and 2, barrel 1 is accommodated in a cradle 2 that pivots on trunnions 3 in bearings 4 secured to turret T. Barrel 1 extends out of the turret through a shield 5. The shield accommodates a channel 5.1 that parallels the bore in barrel 1. The initial section 6.1 of the optical axis of a sight 6, which is mounted stationary on the weapon, extends through cradle 2, and its subsequent section 6.2 extends straight out of the first section and through the channel 5.1 in shield 5 toward an objective 6.3 on the front of the shield. The channel represents a significant weakening in the defensive superstructure at the front of the turret.

Figure 3:
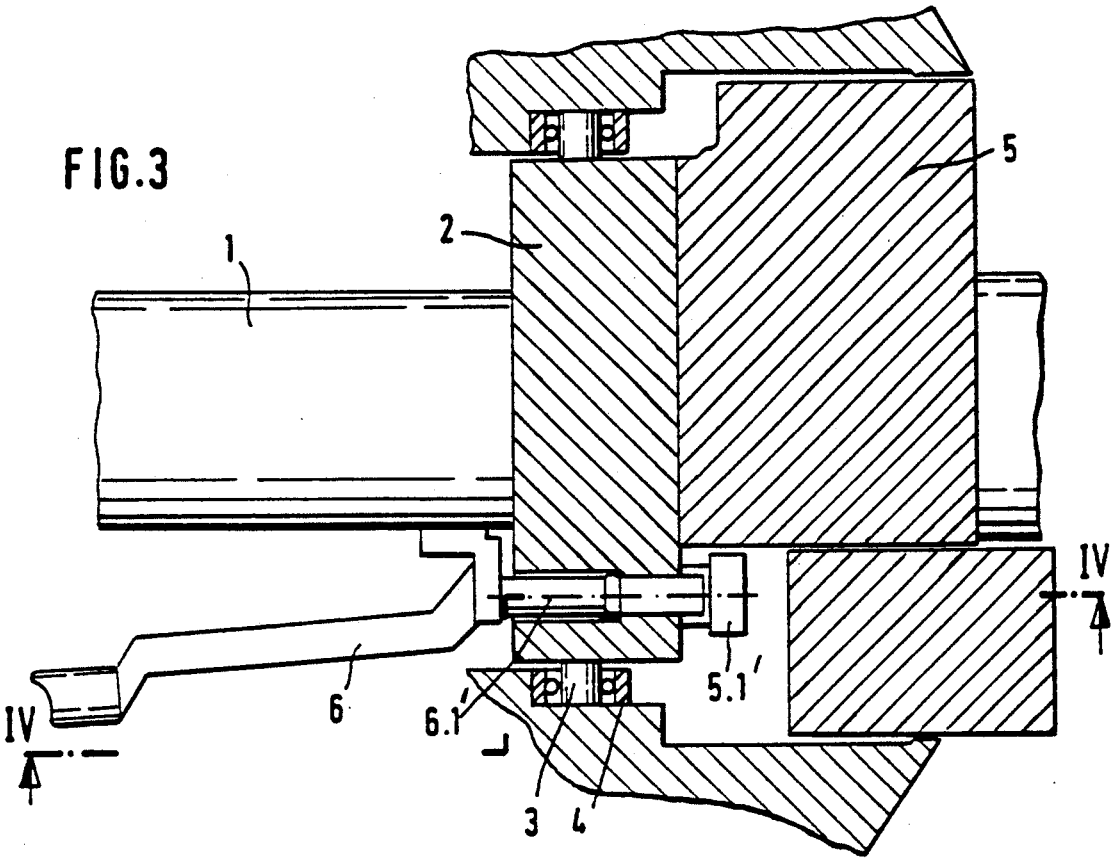
FIG. 3 is a representation similar to that in FIG. 1 of the vicinity of the cradle and shield on a turret in accordance with the invention.
Figure 4:
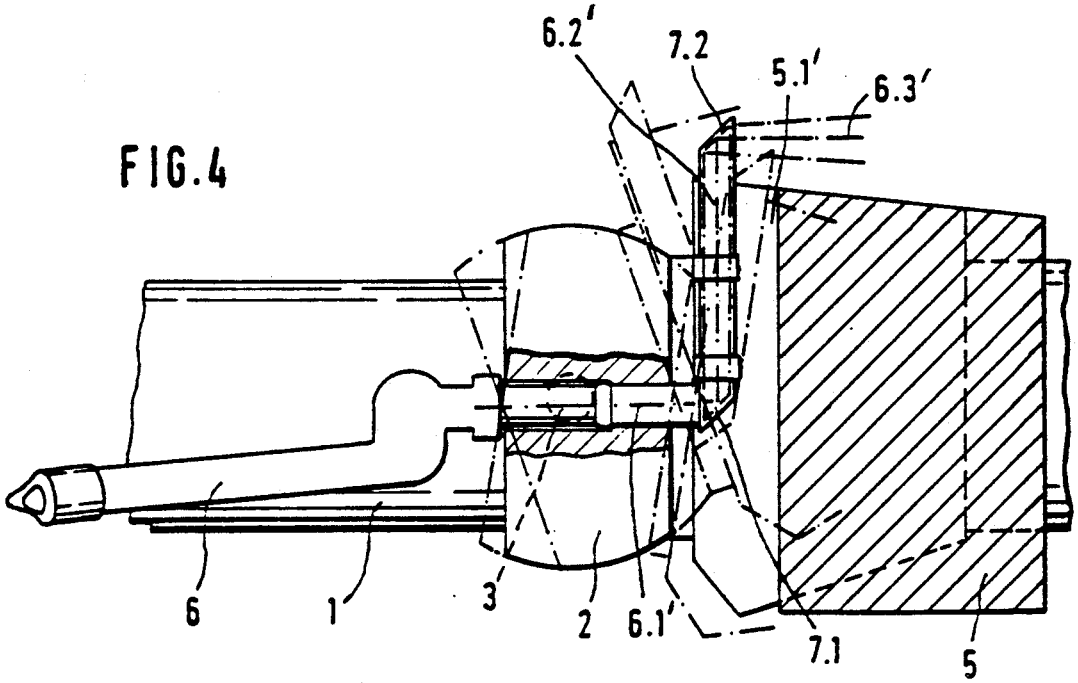
FIG. 4 is a section along the line IV—IV in FIG. 3.
Figure 5:
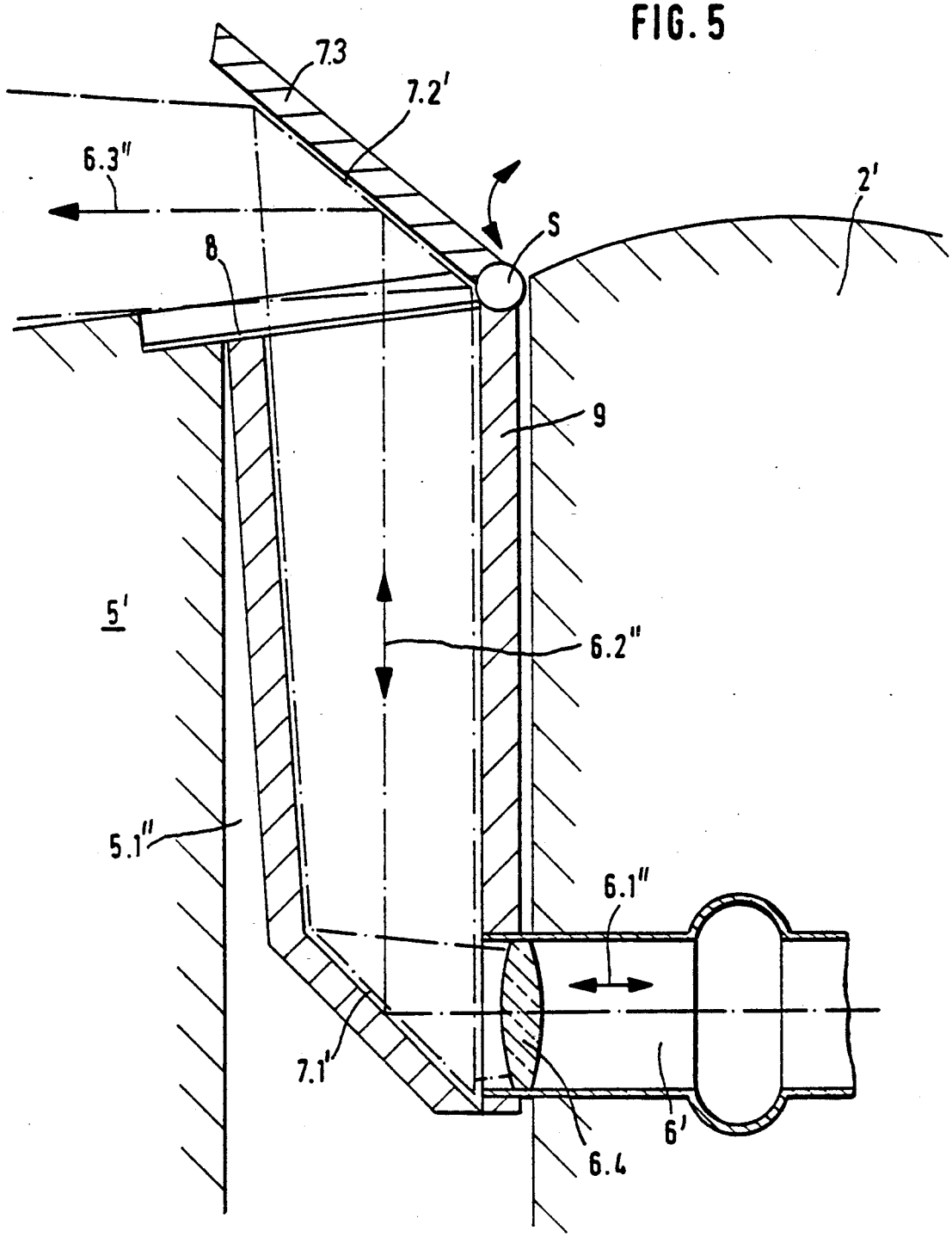
FIG. 5 is a larger-scale detail of the view in FIG. 4.

To eliminate the weakening, the optical axis of sight 6 is deflected in accordance with the invention as illustrated in FIGS. 3 through 5.

Figure 2:
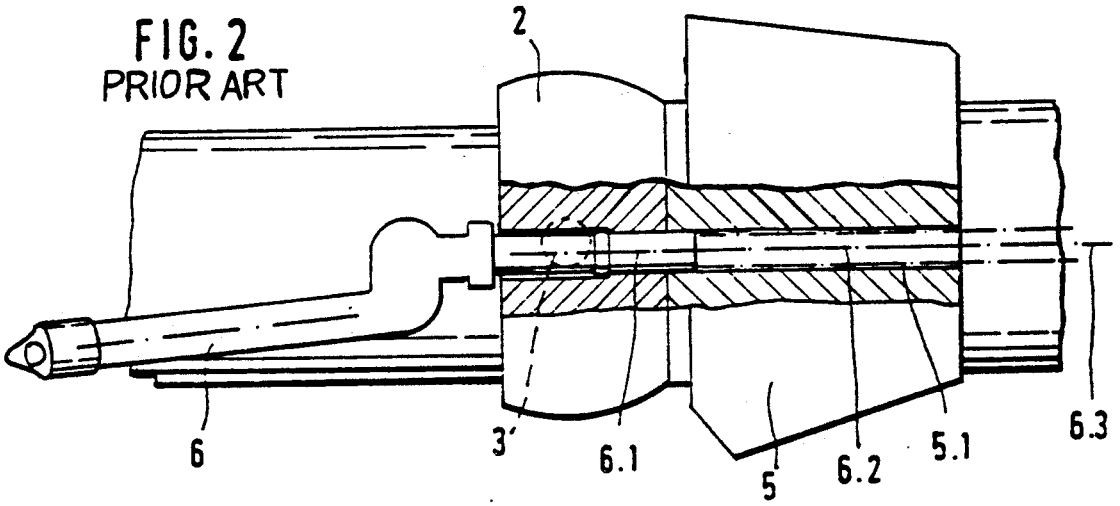
FIG. 2 PRIOR ART
FIG. 2 is a section along the line II—II in FIG. 1.

Components that are similar to those represented in FIGS. 1 and 2 are labeled with the same numbers. Barrel 1 extends through cradle 2 and shield 5. The initial section 6.1' of the optical axis of sight 6 extends straight through cradle 2. Positioned along the optical axis between cradle 2 and shield 5 is a mirror 7.1 that deflects the second section 6.2' of the optical axis up through a perforation 5.1' to a point above shield 5. This point can be on the front or top of or inside the turret. At this location is a second mirror 7.2 that deflects the third section of the optical axis toward an unillustrated objective 6.3'. Various elevations are illustrated by the dot-and-dash lines in FIG. 4.

FIG. 5 represents the deflected sections of the optical axis. Upward section 6.2'' extends through a tube 9 that is mounted along with an objective lens 6.4 on the section of sight 6' that extends through cradle 2' and is positioned inside the perforation 5.1'' behind shield 5'. Mirror 7.1' deflects section 6.2'' up. To prevent tube 9, which is open at the top, from becoming contaminated, a cap 7.3 folds down tight over its upper end around a horizontal axis S against seals 8. When the sight is in operation, the cap is folded up into a prescribed position, wherein second mirror 7.2' is in the precise position for deflecting the optical axis toward objective 6.3''.

Figure 6:
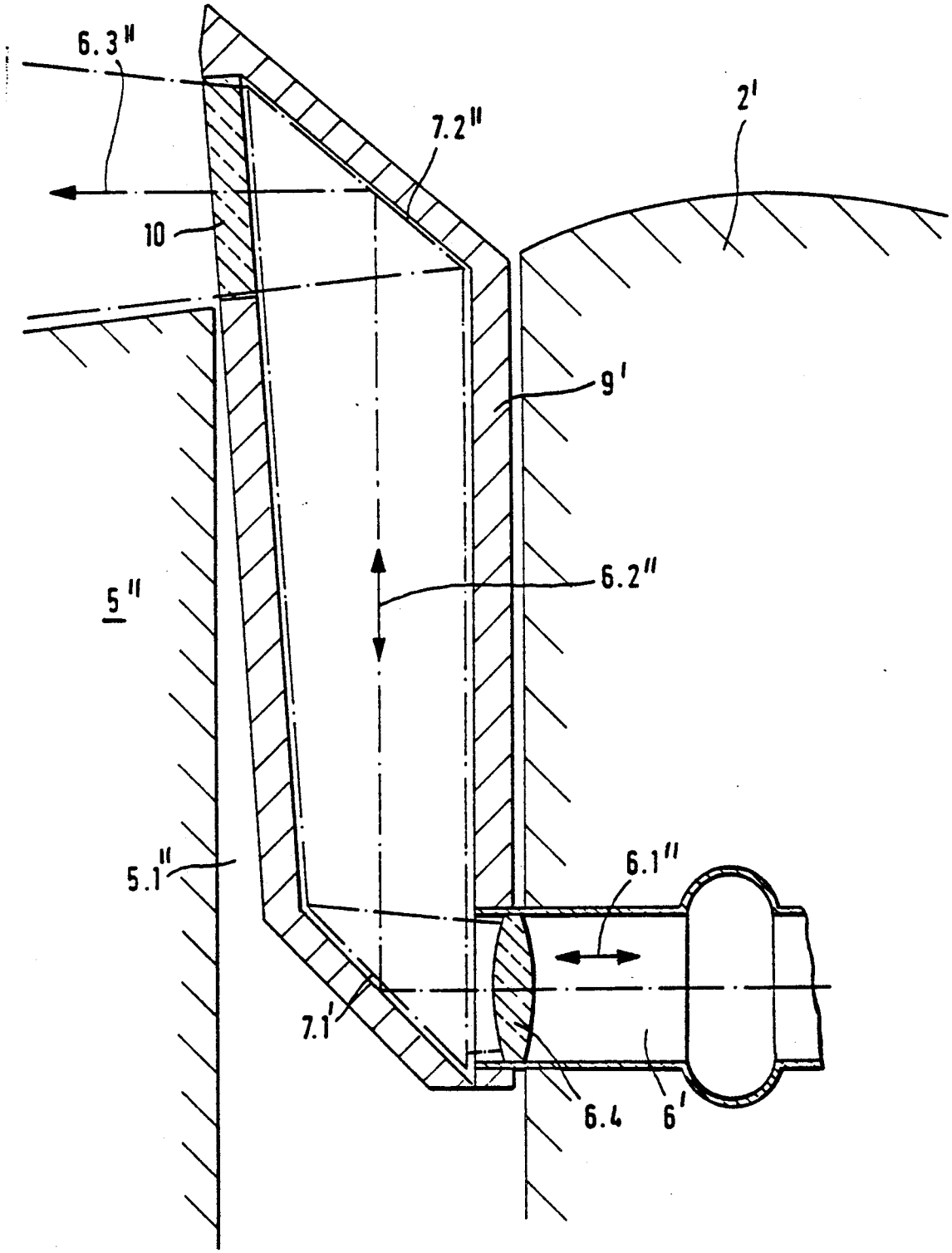
FIG. 6 is a representation similar to that in FIG. 5 of a slightly different embodiment.

FIG. 6 illustrates another version of the section of the optical axis illustrated in FIG. 5, wherein mirror 7.2'' is secured stationary to the upper end of tube 9' behind shield 5''. The end of the tube that faces objective 6.3'' is covered with a transparent disk 10.

What is claimed is:

1. A turret for a military tank having a weapon barrel with a bore and mounted in a cradle on the turret and extending out through a shield and a sight mounted stationary on the weapon and having means forming an optical axis extending through the cradle, parallel to a longitudinal axis of the bore and toward an objective on the outside of the turret, wherein the means forming the optical axis of the sight comprises a first optical deflector between the cradle and the shield to upwardly deflect the optical axis to a point in or on the turret and above the shield and a second optical deflector to forwardly deflect the optical axis towards an objective

2. The tank as in claim 1, wherein the first and second optical deflectors comprise mirrors.

3. The tank as in claim 2, wherein the second optical deflector is a mirror on an inner surface of a cap that folds down around a horizontal axis and seals off a channel that accommodates an upward section of the optical axis.

* * * * *